US010197290B2

(12) United States Patent
Lee

(10) Patent No.: US 10,197,290 B2
(45) Date of Patent: Feb. 5, 2019

(54) OVEN

(71) Applicant: Samsung Electronics Co., Ltd., Suwon-si (KR)

(72) Inventor: Dong Ho Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 505 days.

(21) Appl. No.: 14/970,988

(22) Filed: Dec. 16, 2015

(65) Prior Publication Data

US 2016/0178216 A1 Jun. 23, 2016

(30) Foreign Application Priority Data

Dec. 19, 2014 (KR) ..... 10-2014-0185022

(51) Int. Cl.
*F24C 15/32* (2006.01)
*F24C 15/00* (2006.01)
*F24C 15/20* (2006.01)

(52) U.S. Cl.
CPC ..... *F24C 15/006* (2013.01); *F24C 15/2007* (2013.01)

(58) Field of Classification Search
CPC .. F24C 15/006; F24C 15/2007; F24C 15/322; F24C 15/327; F24C 7/087; F24C 15/164; A47J 2027/043; A47J 2202/00; A47J 27/04; A47J 27/10; A47J 27/21041; A47J 27/2105; A47J 27/21083; A47J 31/4417; A47J 31/4425; A47J 31/4457; A47J 36/2416; A47J 36/2466; A47J 36/32; A47J 39/025; A47J 41/0044; A47J 41/0094;

(Continued)

(56) References Cited

U.S. PATENT DOCUMENTS 3,889,100 A 6/1975 Dills
5,918,589 A 7/1999 Valle et al.

(Continued)

FOREIGN PATENT DOCUMENTS

EP 1640667 3/2006
EP 1795812 A2 6/2007
WO 2008/074714 A1 6/2008

OTHER PUBLICATIONS

Communication pursuant to Article 94(3) EPC dated Mar. 3, 2017 corresponding to European Application No. EP 15196424.4.

(Continued)

*Primary Examiner* — Jason Lau
(74) *Attorney, Agent, or Firm* — Staas & Halsey LLP

(57) ABSTRACT

Disclosed herein is an oven having a display module provided at a front of an electrical compartment, an outside air inlet unit formed at a body such that the air of the outside of the body may be inlet from an upper side of the display module, and a guide member provided at the electrical compartment as to guide the air inlet through the outside air inlet unit to move from the upper portion of the display module to a lower portion of the display module, thereby increasing cooling efficiency of the display module. In addition, the amount of the exhaust air of a cooking compartment may be adjusted while provided with a bypass hole to inlet the air of a cooling path into an exhaust path, and an opening/closing apparatus to open/close the bypass hole.

20 Claims, 18 Drawing Sheets

(58) Field of Classification Search
CPC .. A21B 3/04; A21B 1/245; A21B 1/40; A21B 1/26; A21B 1/48; A21B 1/24; A21B 3/00; A21B 2/00; A21B 1/36
See application file for complete search history.

(56) References Cited

U.S. PATENT DOCUMENTS

| | | | | |
|---|---|---|---|---|
| 6,621,058 | B1 | 9/2003 | Kim | |
| 2004/0000547 | A1* | 1/2004 | Kim | H05B 6/6429 219/757 |
| 2004/0134900 | A1* | 7/2004 | Chun | H05B 6/6435 219/702 |
| 2006/0157481 | A1 | 7/2006 | Oh et al. | |
| 2007/0131220 | A1* | 6/2007 | Kim | F24C 15/006 126/273 R |
| 2009/0242542 | A1* | 10/2009 | Kwag | F24C 15/006 219/391 |
| 2011/0186030 | A1 | 8/2011 | Turek et al. | |

OTHER PUBLICATIONS

Communication dated May 9, 2016 with Partial European Search Report corresponding to European Application No. EP 15196424.4.
Communication under Rule 71(3) EPC dated Sep. 1, 2017 corresponding to European Application No. EP 15196424.4.
Communication dated Sep. 9, 2016 with European Search Report corresponding to European Application No. EP 15196424.4.

* cited by examiner

OVEN

RELATED APPLICATION(S)

This application claims the benefit of the Korean Patent Application No. 2014-0185022, filed on Dec. 19, 2014, in the Korean Intellectual Property Office, the disclosure of which is incorporated herein by reference.

BACKGROUND

Embodiments of the present disclosure relate to an exhaust structure and a cooling structure of an oven.

In general, an oven is an apparatus that cooks food while provided with a cooking compartment, a heating apparatus to apply heat at the cooking compartment, and a circulating fan to circulate the heat generated at the heating apparatus at an inside of the cooking compartment.

The oven is provided with a cooling structure to cool the surroundings of the cooking compartment such that electrical components disposed at an electrical compartment damageable by heat, or a user or furniture adjacent the oven may not be affected. In general, the cooling structure generally circulates air in the cooking compartment with a blower fan. However, a display module displays operation and/or motion information of the oven is disposed at a front of the electrical compartment, and thus an efficiency of cooling through air circulation may be decreased by a certain degree.

In addition, the oven is provided with an exhaust structure to exhaust the air of the cooking compartment to maintain pressure, remove moisture, and remove hazardous gas and smell, followed by an increase of temperature in the cooking compartment.

The exhaust structure is not provided to use a separate blower fan to generate inflow force, but is provided to use a method of the Venturi effect to allow the air of the cooking compartment to flow in and exhaust along with the circulating current that circulates at the surroundings of the cooking compartment.

SUMMARY

Therefore, it is an aspect of the present disclosure to provide an oven having a cooling structure capable of effectively cooling a display module provided at a front of an electrical compartment.

It is another aspect of the present disclosure to provide an oven having an exhaust structure capable of adjusting the amount of air being exhausted from a cooking compartment to an outside.

Additional aspects of the disclosure will be set forth in part in the description which follows and, in part, will be obvious from the description, or may be learned by practice of the disclosure.

In accordance with one aspect of the present disclosure, an oven includes a body having a front, an inside, and an outside; an electrical compartment formed at the inside of the body, and having an inside; a cooling fan provided at the inside of the electrical compartment, configured to generate an inflow force to inflow air at the outside of the body into the inside of the electrical compartment, and to outflow the air to the front of the body after having the air moved at the inside of the electrical compartment; a display module provided at a front of the electrical compartment, and having an upper side and a lower portion; an outside air inlet unit formed at the body such that the air of the outside of the body is inlet from the upper side of the display module by use of the inflow force of the cooling fan; and a guide member provided at the electrical compartment as to interrupt the air inlet into the outside air inlet unit from moving toward the cooling fan and to guide the air to move from the upper side of the display module to the lower portion of the display module.

The outside air inlet unit may be provided with a slit shape extended lengthways in both directions of the body.

The body includes an upper case forming an upper surface of the electrical compartment, and an electrical compartment cover forming a front surface of the electrical compartment while coupled to a front of the upper case, and the outside air inlet unit may be formed in between the upper case and the electrical compartment cover.

The electrical compartment cover includes a front surface unit, and a rear direction extension unit extended from the front surface unit to a rear; the upper case includes an upper surface unit, an upper direction extension unit extended from the upper surface unit to an upper direction, and a bend unit bent at the upper direction extension unit; and the outside air inlet unit may be formed in between the rear direction extension unit and the bend unit.

The guide member is provided with the shape of a panel, and may be disposed lengthways in a vertical direction at the electrical compartment.

The oven may include a descending path formed in between the guide member and the display module such that the air inlet through the outside air inlet unit may be descended.

A lower side of the guide member may be provided with a descending path exit formed thereof such that the air moving downward along the descending path may move toward the cooling fan.

The guide member may include a printed circuit board to control the display module.

The display module may include a liquid crystal display (LCD).

The display module may include a touch panel capable of receiving a command input through a touch while coupled to a front surface of the liquid crystal display.

The oven may include a cooking compartment provided at a lower side of the electrical compartment; a cooling path formed in between the electrical compartment and the cooking compartment as to guide the air flown in by use of the cooling fan to a front of the body; and an exhaust path connecting the cooking compartment and the cooling path as to exhaust the air of the cooking compartment into the cooling path.

The oven may include a base bracket provided in between the cooking compartment and the electrical compartment; a cover bracket coupled to an upper portion of the base bracket as to form the cooling path; an exhaust bracket coupled to a lower portion of the base bracket as to form the exhaust path; an exhaust hole formed at the base bracket as to exhaust the air of the exhaust path into the cooling path; a bypass hole formed at the base bracket as to have a portion of the air moving at the cooling path inlet into the exhaust path; and an opening/closing apparatus to open/close the bypass hole as to adjust the amount of the air of the cooking compartment being exhausted into the cooling path.

The amount of the air of the cooking compartment being exhausted into the cooling path may be increased when the bypass hole is closed, and the amount of the air of the cooking compartment being exhausted into the cooling path may be decreased when the bypass hole is open.

The amount of the air being exhausted from the exhaust path into the cooling path may be about equal to the sum of the amount of the air being exhausted from the cooking compartment into the exhaust path and the amount of the air being inlet from the cooling path into the exhaust path through the bypass hole.

The amount of the air being exhausted from the exhaust path into the cooling path may be steadily maintained regardless of the opening/closing of the bypass hole.

The cooling path includes a width decreasing unit having an upper/lower gap narrowed further toward a front and a width maintaining unit having an upper/lower gap steadily maintained, and the bypass hole is formed at the width decreasing unit and the exhaust hole may be formed at the width maintaining unit.

The opening/closing apparatus may be mounted at the cover bracket.

The cover bracket is provided with an opening/closing apparatus mounting unit to mount the opening/closing apparatus, and the opening/closing apparatus mounting unit may include a supporting unit at which the opening/closing apparatus is supported and a passing hole through which the opening/closing apparatus is passed.

The opening/closing apparatus may include a rod to move in a linear motion, and an opening/closing member provided at an end portion of the rod as to open/close the bypass hole.

The oven may be provided with a first cooking mode, and a second cooking mode to cook by exhausting the relatively higher amount of the air of the cooking compartment than the amount of the air of the cooking compartment in the first cooking mode.

In accordance with another aspect of the present disclosure, an oven includes a case having an upper case, a lower case, a side case, and a rear case; an electrical compartment formed at an inside of the case and having an open front surface; an electrical compartment cover to cover the open front surface of the electrical compartment and at which a display module is mounted, the display module having an upper side; a cooling fan provided at an inside of the electrical compartment, and configured to generate an inflow force to move air; and an outside air inlet unit formed in between the upper case of the case and the electrical compartment cover such that the air of the outside of the case inlets from the upper side of the display module by use of the inflow force of the cooling fan.

The oven may include a guide member provided at the electrical compartment as to guide the air inlet through the outside air inlet unit to move from the upper portion of the display module to a lower portion of the display module.

The oven may include a cooling path into outflow the air flown in by use of the cooling fan to a front of the case; an exhaust path into exhaust the air of the cooking compartment into the cooling path; an exhaust hole to exhaust the air of the exhaust path into the cooling path; a bypass hole to inlet the air of the cooling path into the exhaust path; and an opening/closing apparatus to open/close the bypass hole as to adjust the amount of the air of the cooking compartment being exhausted.

In accordance with an aspect of the present disclosure, cooling efficiency of a display module of a front of an electrical compartment may be increased. Therefore, heat generating material provided to generate higher heat than conventional heat generating material may be used at the display module, and a high-temperature cleaning, such as a pyrolytic cleaning, may be conducted at the time of when cleaning a cooking compartment.

In addition, in accordance with an aspect of the present disclosure, the amount of the air being exhausted to an outside from a cooking compartment may be adjusted. Therefore, an oven may offer various cooking modes. As one example, the oven may offer a general cooking mode to cook by use of an ordinary amount of exhaust, and a crispy cooking mode capable of crisply cooking food by increasing an amount of the exhaust of the cooking compartment.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
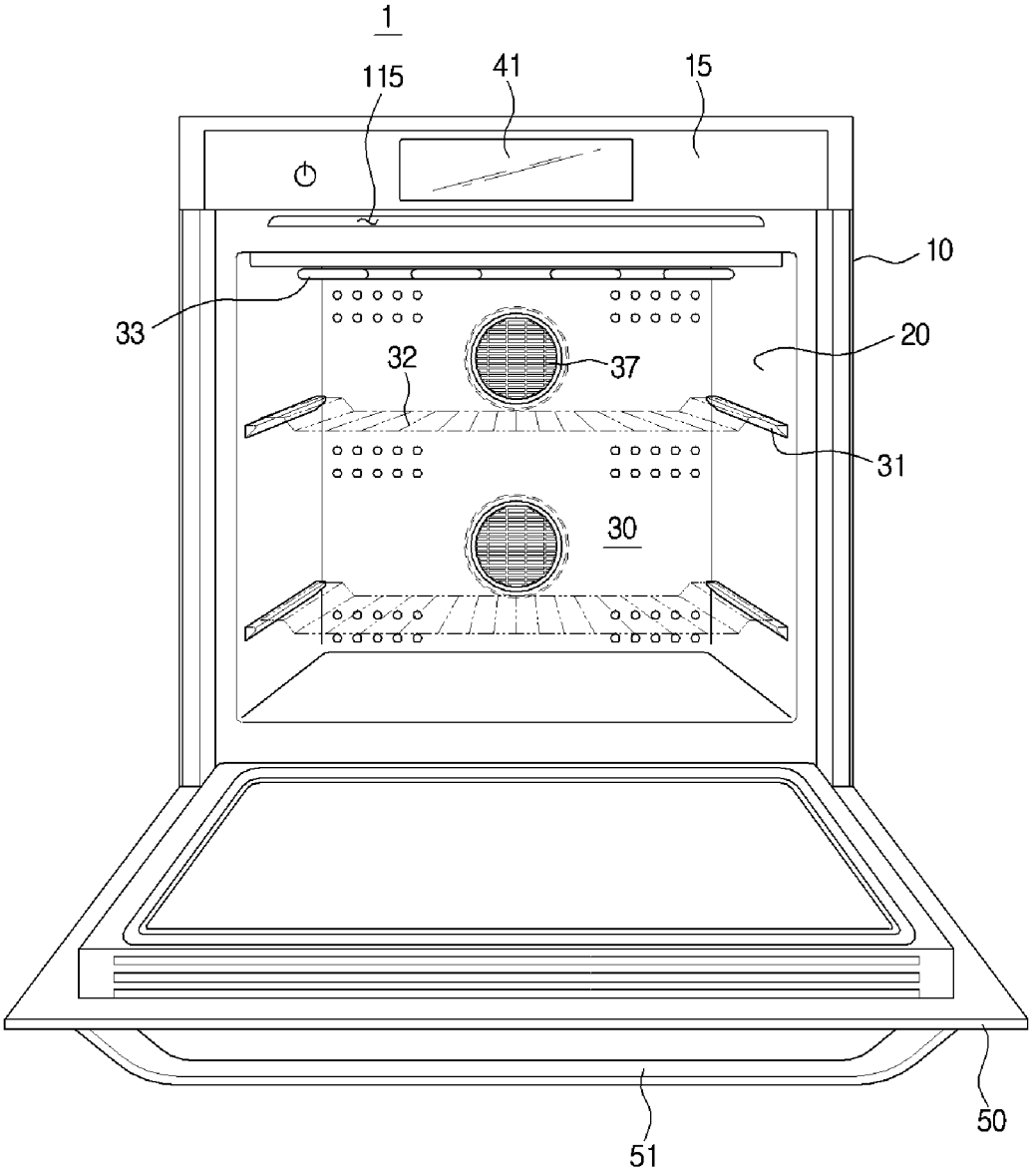
FIG. 1 is a drawing illustrating a front exterior appearance of an oven according to an embodiment of the present disclosure.

Reference will now be made in detail to the embodiments of the present disclosure, examples of which are illustrated in the accompanying drawings, wherein like reference numerals refer to like elements throughout. In the embodiments of the present disclosure, a terminology "refrigeration" will be used as to refer to a radiation of the heated air, which is of the various components that are heated by the heat generated from a heater 33 and a light source unit of a display module 41, at an approximate room temperature by means of a heat exchange through a circulation of air, and will not be used as to refer to a refrigeration of the heated air below the room temperature. Therefore, the terminology "refrigeration" in the embodiment of the present disclosure may be referred to as the terminology that is closer to "cooling" rather than "freezing" by definition.

Figure 2:
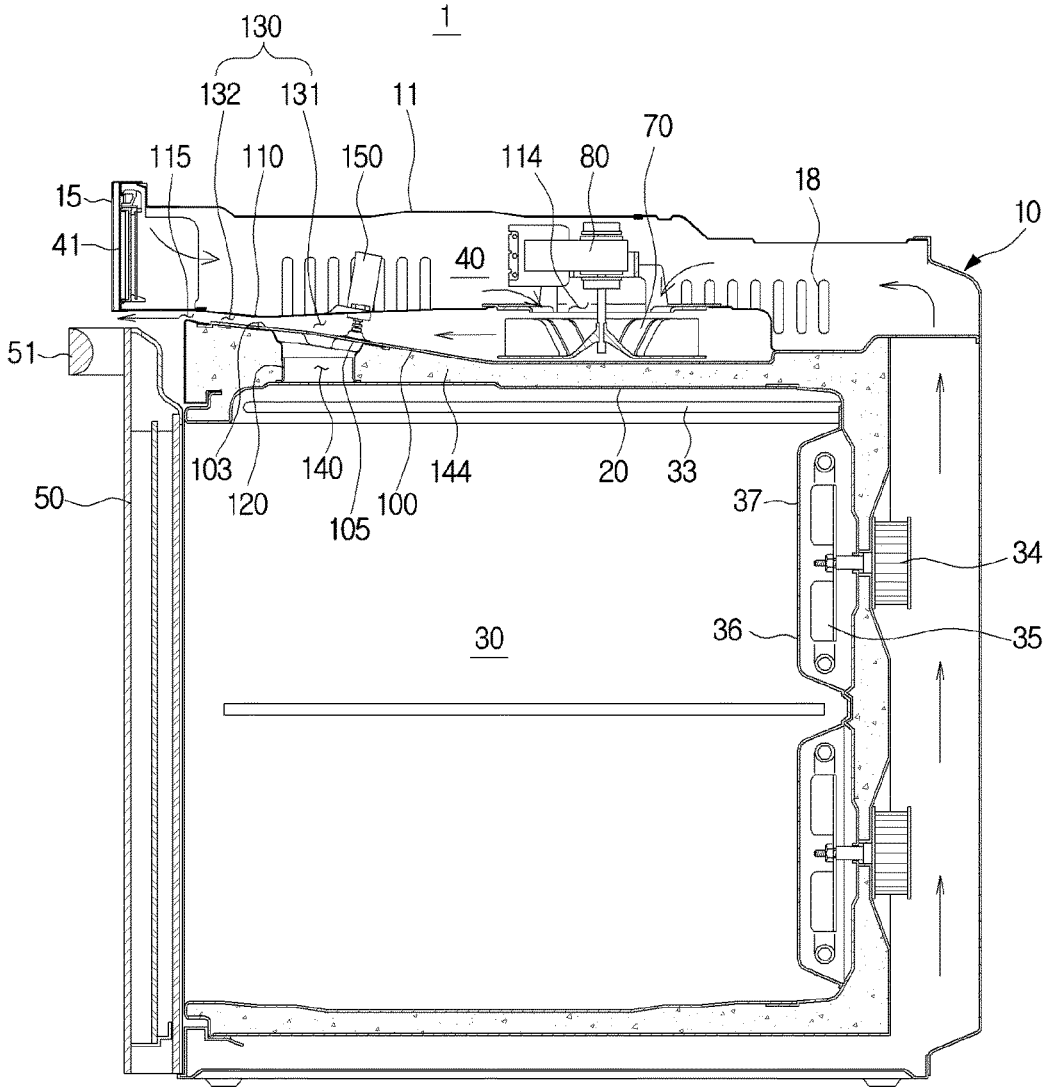
FIG. 2 is a side view illustrating a schematic structure of the oven of FIG. 1.
Figure 3:
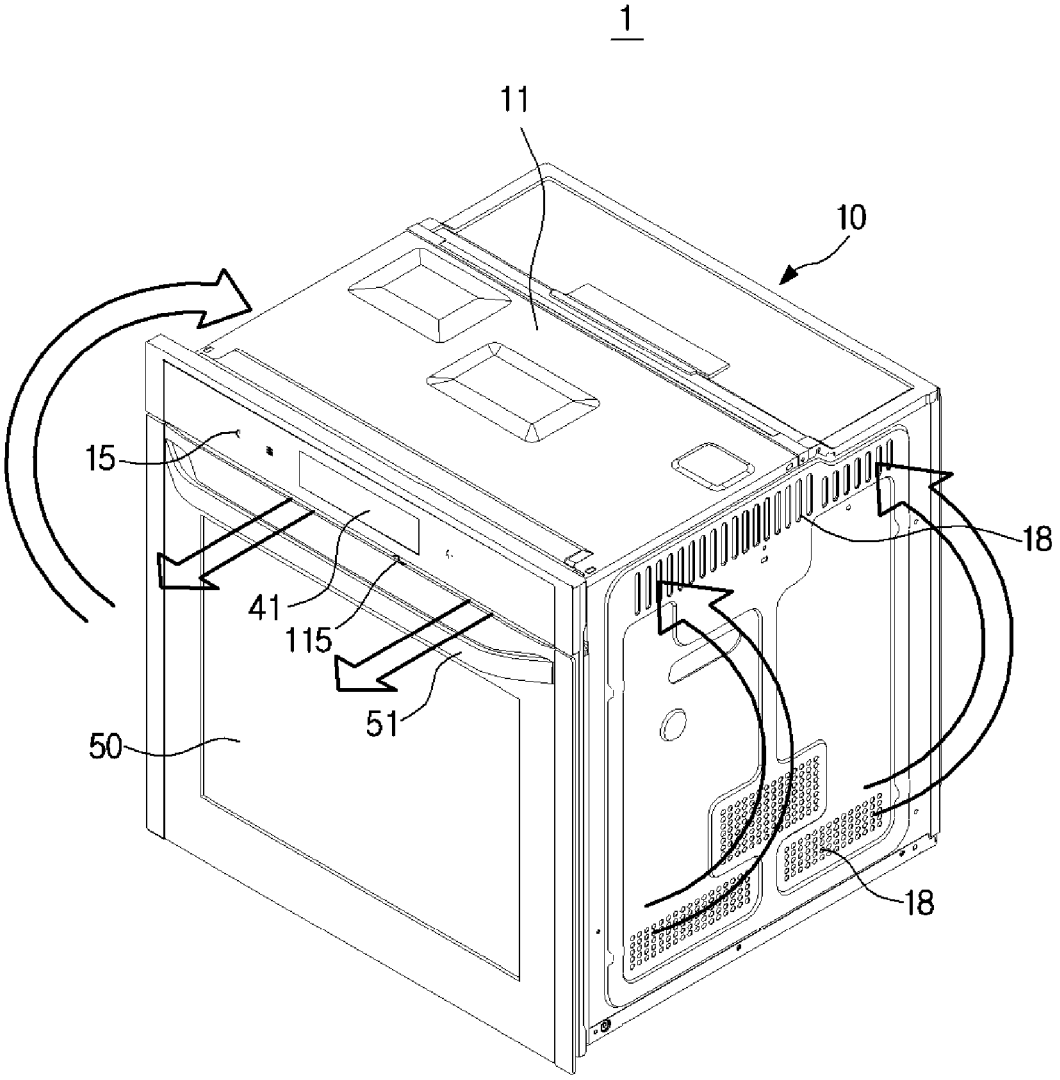
FIG. 3 is a perspective view to describe a cooling structure of the oven of FIG. 1.
Figure 4:
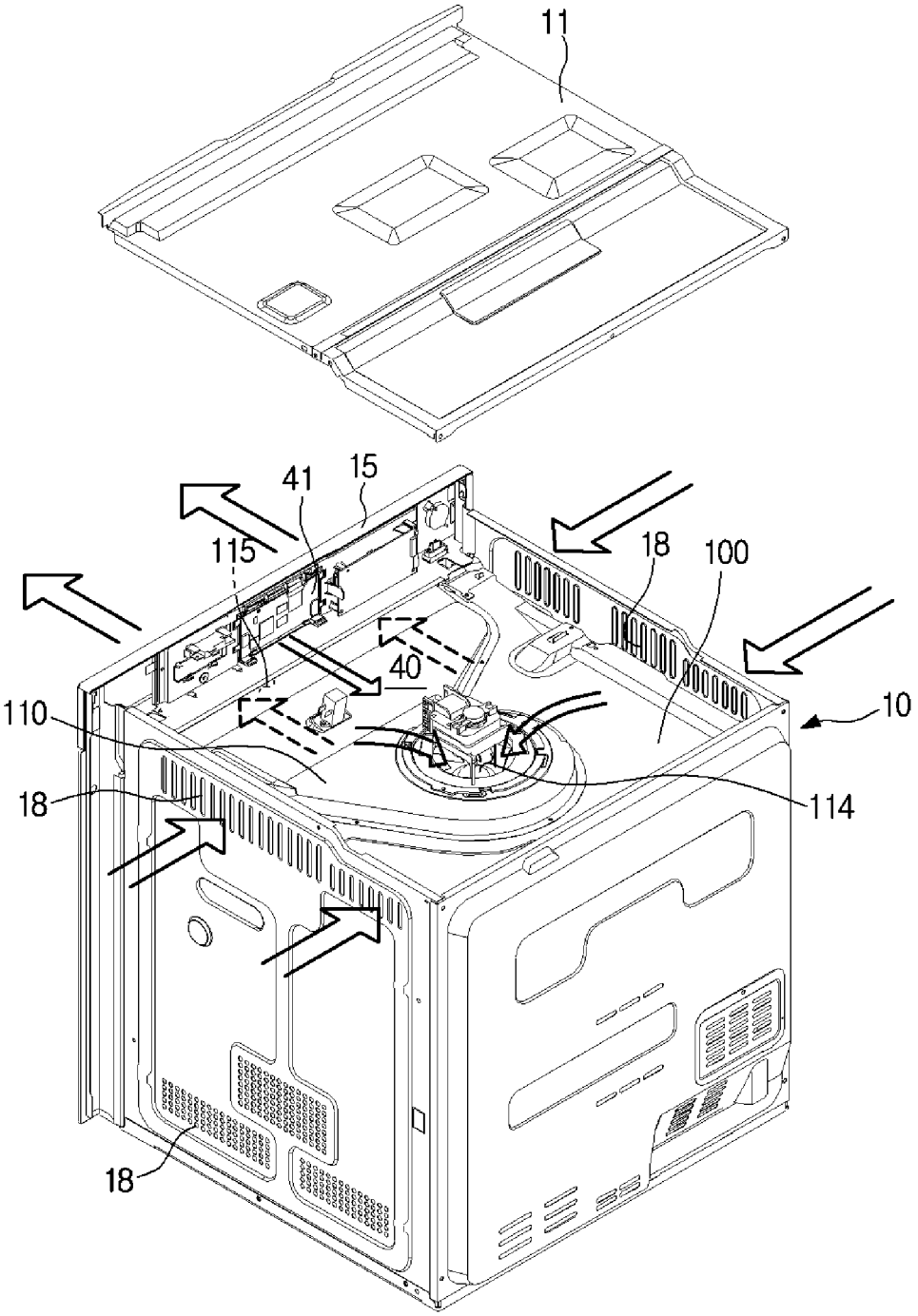
FIG. 4 is a perspective view from a different direction to describe the cooling structure of the oven of FIG. 1.

FIG. 1 is a drawing illustrating a front exterior appearance of an oven 1 according to an embodiment of the present disclosure. FIG. 2 is a side view illustrating a schematic structure of the oven 1 of FIG. 1. FIG. 3 is a perspective view to describe a cooling structure of the oven 1 of FIG. 1. FIG. 4 is a perspective view from a different direction to describe the cooling structure of the oven 1 of FIG. 1.

Referring to FIG. 1 through FIG. 4, an oven 1 is provided with a body having an inside case 20 at which a cooking compartment 30 is formed at an inside thereof, and an outside case 10 coupled to an outer side of the inside case 20 and forming an exterior appearance of the oven 1. The inside case 20 and the outside case 10 each may be provided with the approximate shape of a box having an open front surface.

The cooking compartment 30 may be provided with the open front surface to allow for deposit or withdrawal of food. The open front surface of the cooking compartment 30 may be open or closed for use via a door 50. The door 50 may be rotatably coupled to a lower portion of the body. A handle 51 may be provided at the door 50 to provide a grip.

The cooking compartment 30 may be mounted with a rack 32 on which food is placed. The rack 32 may be mounted at guide rails 31 provided at both sides of the cooking compartment 30.

The cooking compartment 30 may be provided with a heater 33 to heat food. The heater 33 in the embodiment of the present disclosure may be an electrical heater having electric resistance material. However, differently from the embodiments of the present disclosure, the heater 33 may be a gas heater that generates heat by combusting gas. That is, the oven 1 according to the embodiments of the present disclosure includes an electrical oven and a gas oven.

A rear of the cooking compartment 30 may be provided with a circulation fan 35 to have food evenly heated by circulating the air of the cooking compartment 30, and a circulation motor 34 to drive the circulation fan 35. A front of the circulation fan 35 may be provided with a fan cover 36 to cover the circulation fan 35, and the fan cover 36 is provided with holes 37 such that air may be moved.

An upper portion of a front surface of the outside case 10 may be provided with the display module 41 to display various operation and/or motion information of the oven 1 and through which a user may input operation and/or motion commands. The display module 41 may be mounted at an electrical compartment cover 15.

The oven 1 is provided with an electrical compartment 40 to accommodate electrical components to control operations and/or motions of various components, including the display module 41. The electrical compartment 40 is provided at an upper portion of the cooking compartment 30. Insulation material 144 may be provided in between the electrical compartment 40 and the cooking compartment 30 as to insulate the cooking compartment 30 and the electrical compartment 40 such that the heat of the cooking compartment 30 may be prevented from being delivered to the electrical compartment 40.

The oven 1 is provided with a cooling structure to cool the electrical compartment 40 by circulating air at the surroundings of the cooking compartment 30. The cooling structure of the oven 1 includes a cooling fan 70, and a cooling path 130 to outflow the air flown in by use of the cooling fan 70 to a front of the oven 1.

As illustrated on FIG. 3 and FIG. 4, a circulation of air may be formed at the surroundings of the cooking compartment 30 by use of the blower force of the cooling fan 70.

The body includes the inside case 20 and the outside case 10, and the outside case 10 may include an upper case 11, a lower case, a side case, and a rear case.

The air outside of the body is flown or introduced into the electrical compartment 40 through holes 18 formed at the side case and the rear case, and the air flown into the electrical compartment 40 is flown in through an inflow unit 114 of the cooling path 130 after cooling the electrical components by moving at an inside of the electrical compartment 40. The air flown into the inflow unit 114 of the cooling path 130 is finally flown out to a front of the oven 1 through an outflow unit 115 of the cooling path 130.

However, the display module 41 displays operation and/or motion information of the oven 1 to an outside is generally provided at a front of the electrical compartment 40, and thus the efficiency of cooling of the display module 41 may be decreased if the cooling structure as such is used only.

Therefore, the cooling structure according to the embodiment of the present disclosure is provided with an outside air inlet unit 60 capable of efficiently cooling the display module 41 provided at a front of the electrical compartment 40. The detailed descriptions will be provided later.

The cooling path 130 may be formed in between a base bracket 100 disposed in between the cooking compartment 30 and the electrical compartment 40, and a cover bracket 110 coupled to an upper portion of the base bracket 100. However, the base bracket 100 and the cover bracket 110 of the embodiment of the present disclosure may be integrally formed.

The cooling path 130 is provided with the inflow unit 114 and the outflow unit 115. The inflow unit 114 may be formed at an upper portion of the cover bracket 110. The outflow unit 115 may be formed in between the cover bracket 110 and the base bracket 100.

The cooling fan 70 may inflow air in an axial direction and then outflow the air in a radial direction while disposed below the inflow unit 114. That is, the cooling fan 70 may be a centrifugal fan. However, differently from the embodiment of the present disclosure, an axial flow fan may be used as the cooling fan 70 depending on the position of the inflow unit 114.

The cooling path 130 includes a width decreasing unit 131 having an upper/lower gap narrowed further toward a front and a width maintaining unit 132 having an upper/lower gap is steadily maintained. As the above, the cooling path 130 is provided with the width decreasing unit 131 and the width maintaining unit 132 as to have the air of the cooking compartment 30 flown into the cooling path 130 by use of the Venturi effect.

That is, the air of the cooling path 130 is accelerated while the pressure thereof is reduced as the air is moved from the width decreasing unit 131 to the width maintaining unit 132. Accordingly, the air outside of the cooling path 130 may be suctioned into the cooling path 130.

That is, in the embodiment of the present disclosure, the air of the cooking compartment 30 may be flown into the cooling path 130 by use of the Venturi effect as the air of the cooling path 130 is moved from the width decreasing unit 131 to the width maintaining unit 132.

In a different aspect, the air of the cooking compartment 30 may be exhausted from the cooking compartment 30 into the cooling path 130 by the Venturi effect.

As the above, the air exhausted from the cooking compartment 30 into the cooling path 130 is merged with the air moving in the cooling path 130, and is finally flown out of the oven 1 through the outflow unit 115 of the cooling path 130.

In detail, as the pressure of the air of the cooling path 130 is reduced while moving from the width decreasing unit 131 to the width maintaining unit 132, the air of the cooking compartment 30 inflows into an exhaust path 140 through a vent hole 21 (FIG. 13), and the air of the cooking compartment 30 flown into the exhaust path 140 inflows into the cooling path 130 through an exhaust hole 103.

The exhaust path 140 is formed in between the base bracket 100 and an exhaust bracket, and the exhaust hole 103 is formed at the base bracket 100.

Meanwhile, the base bracket 100 is provided with a bypass hole 105, which inlets a portion of the air moving from the inflow unit 114 to the outflow unit 115 of the cooling path 130 into the exhaust path 140 additionally, formed thereat. The bypass hole 105 is open/closed via an opening/closing apparatus 150, and the amount of the air exhaust of the cooking compartment 30 being exhausted into the cooling path 130 according to the opening/closing of the bypass hole 105 may be adjusted. The details of the above will be described hereinafter.

Figure 5:
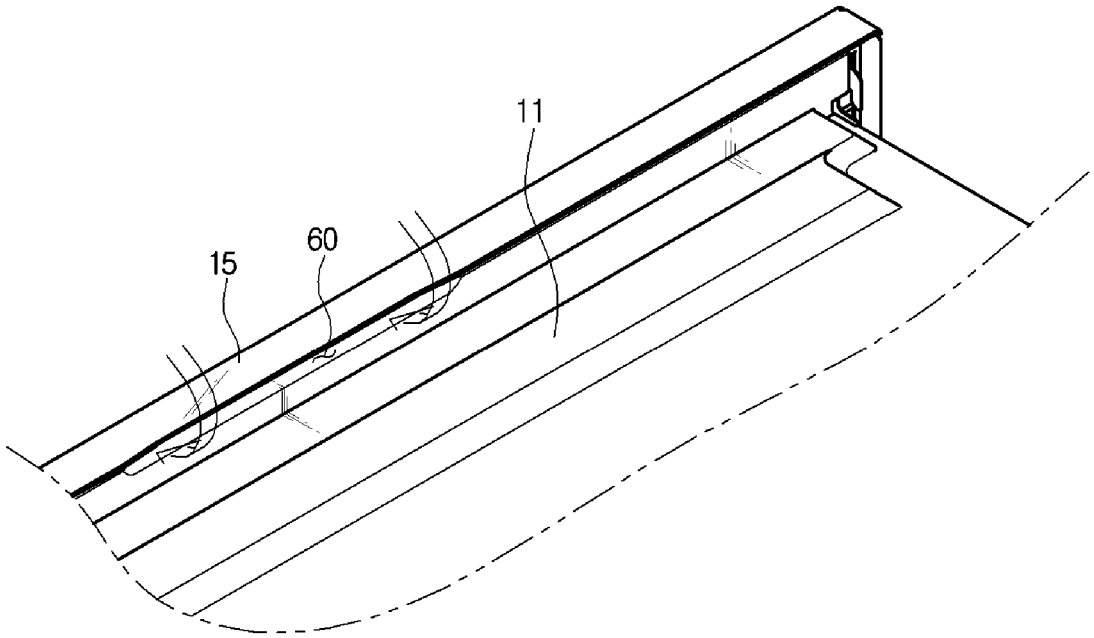
FIG. 5 is a drawing illustrating an enlarged view of an outside air inlet unit of the oven of FIG. 1.
Figure 6:
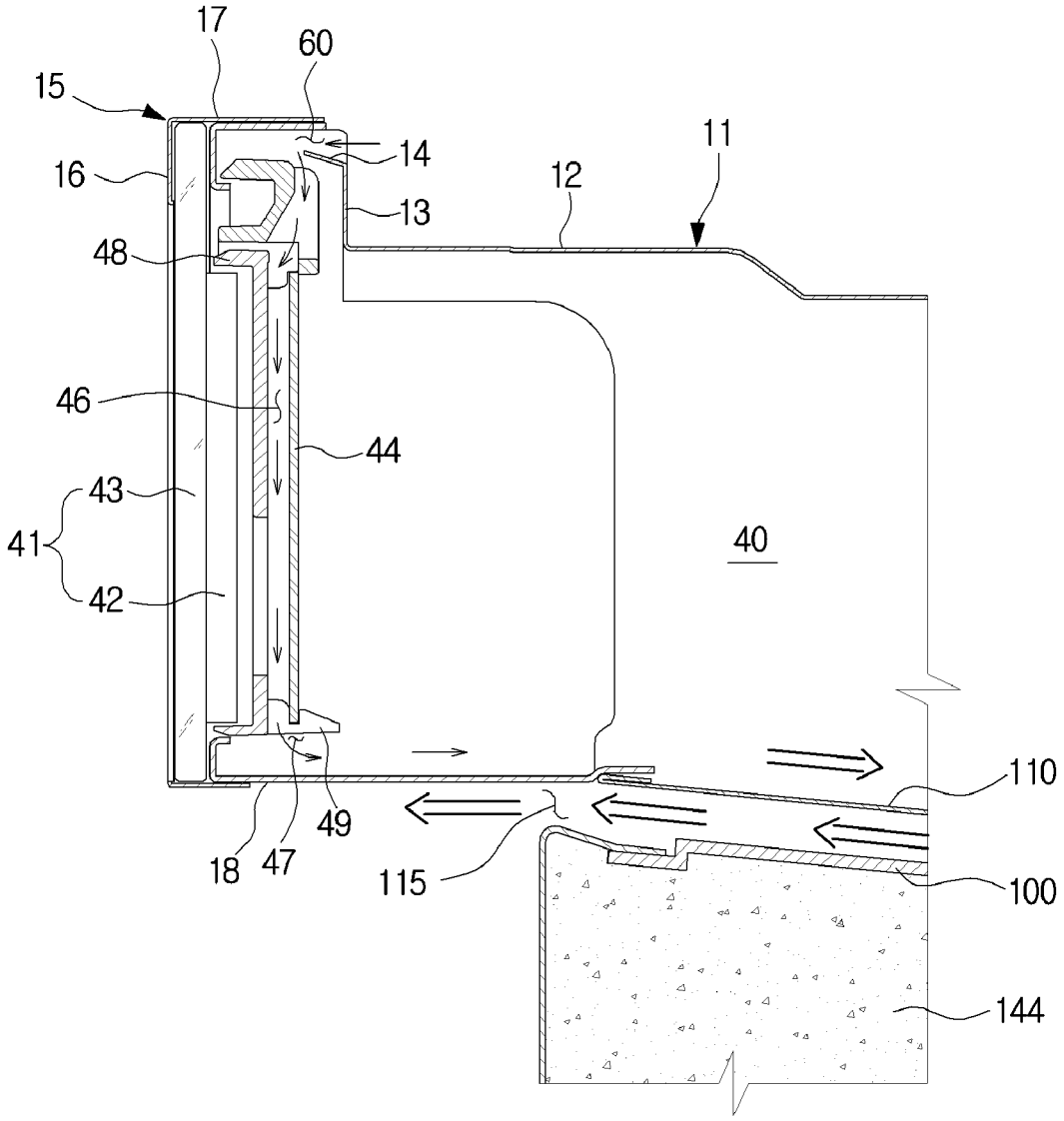
FIG. 6 is a cross-sectional view to describe the cooling structure of the oven of FIG. 1.
Figure 7:
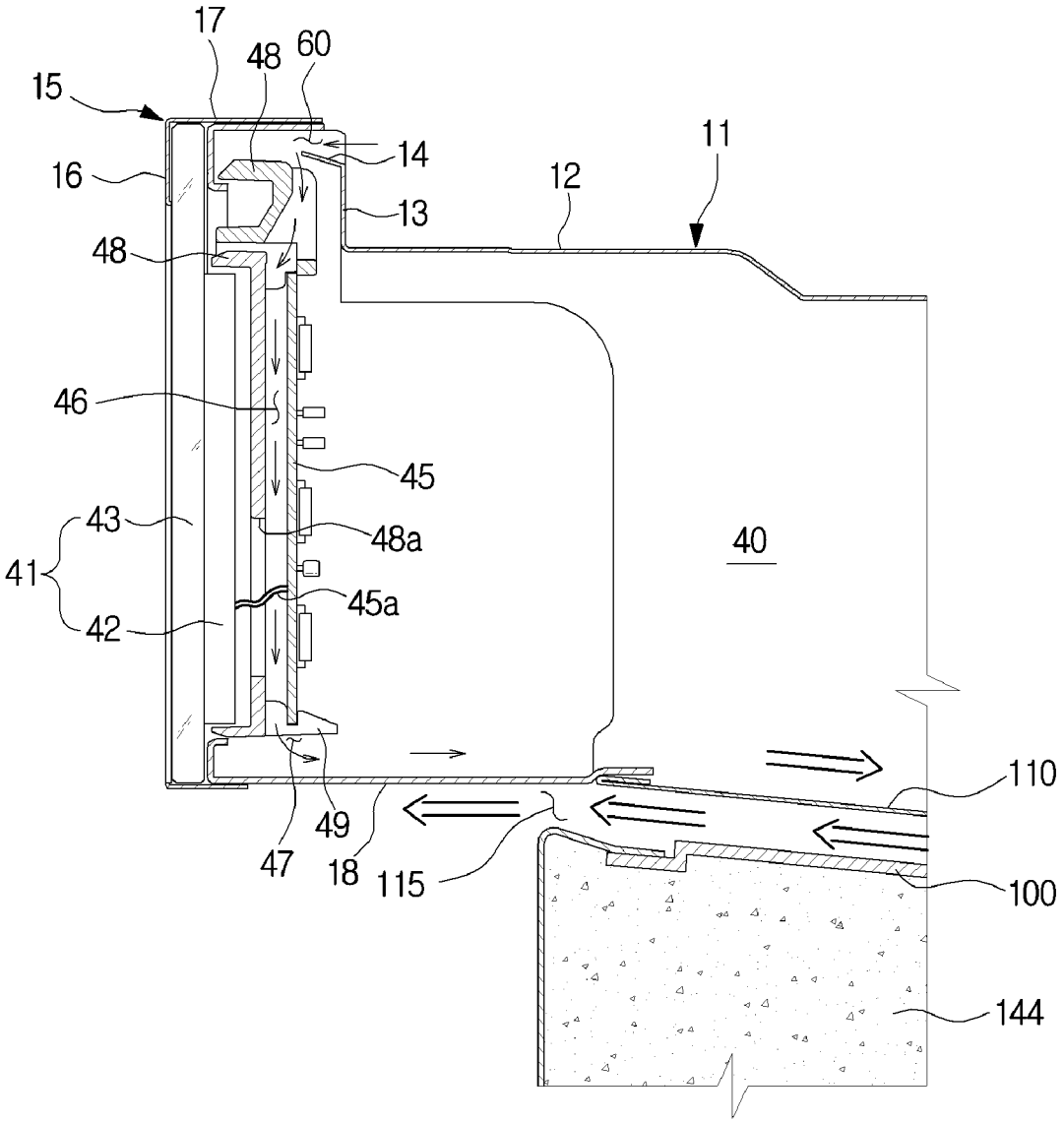
FIG. 7 is a cross-sectional view to describe the cooling structure of the oven of FIG. 1 according to another embodiment of the present disclosure.
Figure 8:
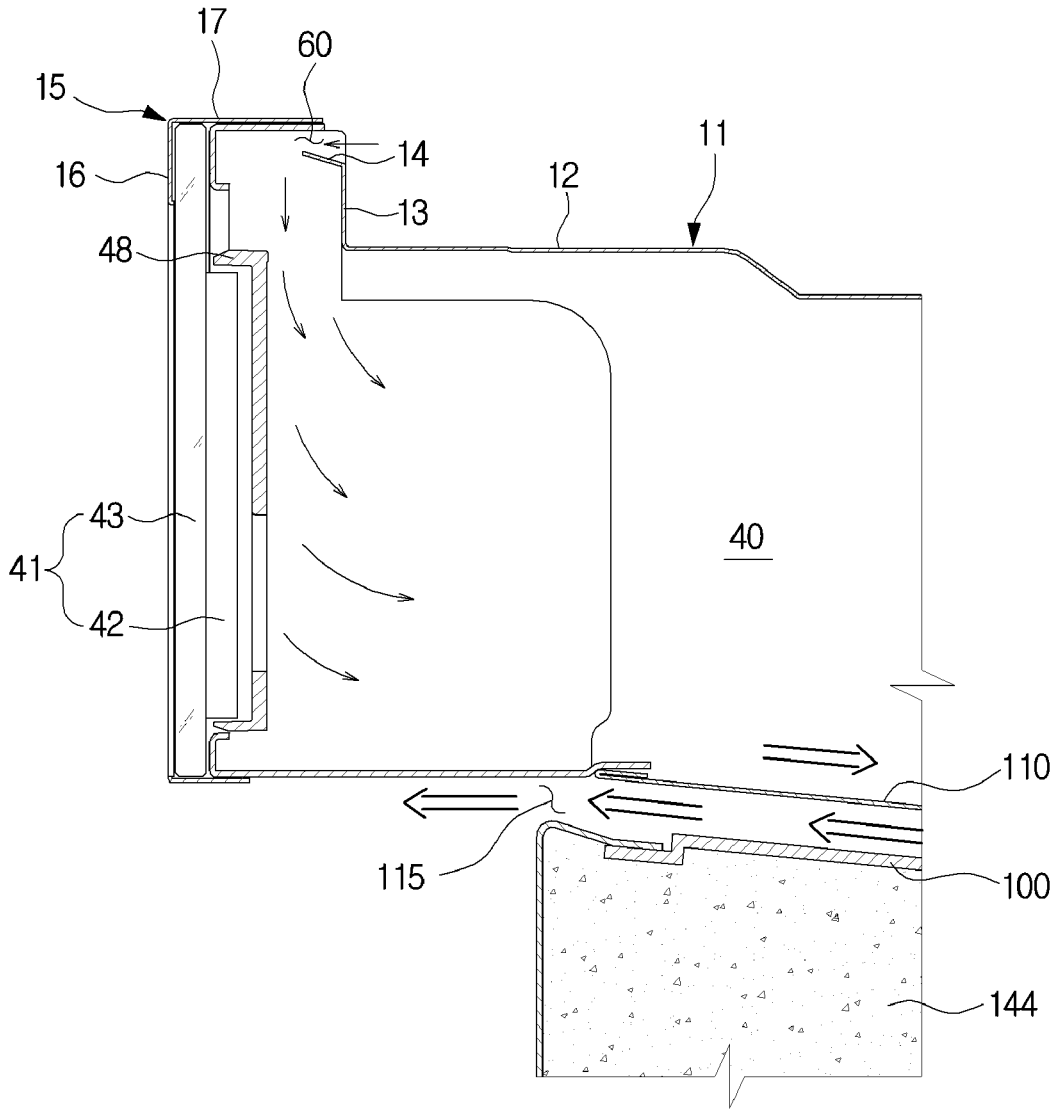
FIG. 8 is a cross-sectional view to describe a cooling structure of the oven of FIG. 1 according to still another embodiment of the present disclosure.

FIG. 5 is a drawing illustrating an enlarged view of the outside air inlet unit of the oven 1 of FIG. 1. FIG. 6 is a cross-sectional view to describe the cooling structure of the oven 1 of FIG. 1. FIG. 7 is a cross-sectional view to describe the cooling structure of the oven 1 of FIG. 1 according to another embodiment of the present disclosure. FIG. 8 is a cross-sectional view to describe a cooling structure of the oven of FIG. 1 according to still another embodiment of the present disclosure.

Referring to FIG. 5 through FIG. 8, the cooling structure of the electrical compartment of the oven according to the embodiment of the present disclosure will be described.

The electrical compartment 40 is provided with a front surface thereof open, and the open front surface of the electrical compartment 40 may be provided with the electrical compartment cover 15 coupled thereto. Therefore, the upper surface of the electrical compartment 40 may be formed by use of the upper case 11 of the outside case 10, and the front surface of the electrical compartment 40 may be formed by use of the electrical compartment cover 15.

A front of the inside of the electrical compartment 40 may be provided with the display module 41 mounted thereto. The display module 41 may be coupled to a lower surface of the electrical compartment cover 15 that covers the open front surface of the electrical compartment 40.

The display module 41 may include a liquid crystal display (LCD).

The liquid crystal display 42 may display electrical information as visual information by use of the degree of liquid crystal transmission that is changed according to authorized power. The liquid crystal display 42 may include a liquid crystal display module to display images, and a light source to radiate light toward the liquid crystal display module. As for the light source, a light emitting diode (LED) may be used.

The display module 41 may include a cover panel 43 provided at a front surface of the liquid crystal display 42. The cover panel 43 may be simply a protective panel that protects the liquid crystal display 42, or a touch panel that may be provided with an input of a touch command by a user.

The display module 41 may be fixed to a front of the electrical compartment 40 by use of a fixing member 48.

The outside air inlet unit 60 is formed in between the electrical compartment cover 15 and the upper case 11 such that the air outside of the body may be inlet from an upper side of the display module 41 by use of the inflow force of the cooling fan 70.

The outside air inlet unit 60 may be provided with a slit shape extended lengthways toward both side directions of the body. However, differently from the embodiments of the present disclosure, the outside air inlet unit 60 may be provided with the shape of a cylinder, an oval, or a polygon. In addition, the outside air inlet units 60 may be provided instead of the single unit of the outside air inlet unit 60.

In detail, the electrical compartment cover 15 includes a front surface unit 16, and a rear extension unit 17 extended to a rear from the front surface unit 16, and the upper case 11 includes an upper surface unit 12, an upward extension unit 13 extended upwardly from the upper surface unit 12, and a bend unit 14 bent at the upward extension unit 13, while the outside air inlet unit 60 may be formed in between the rear extension unit 17 of the electrical compartment cover 15 and the bend unit 14 of the upper case 11.

In addition, the electrical compartment 40 may be provided with a guide member 44 (FIG. 6) to guide the air inlet through the outside air inlet unit 60 from an upper portion to a lower portion of the display module 41.

The guide member 44, while near the display module 41, is provided to have the air inlet through the outside air inlet unit 60 moved from the upper portion to the lower portion of the display module 41 while interrupting the air from moving toward the cooling fan 70. Therefore, the air inlet through the outside air inlet unit 60 may stay further longer near the display module 41 via the guide member 44, and the display module 41 may be thoroughly cooled from the upper end to the lower end thereof.

The guide member 44 is provided with the approximate shape of a panel, and may be disposed lengthways in a vertical direction at the electrical compartment 40.

Therefore, a descending path 46 may be formed in between the display module 41 and the guide member 44 as to guide the air inlet through the outside air inlet unit 60 toward a lower direction. The air inlet through the outside air inlet unit 60 is descended along the descending path 46 while entirely cooling from the upper portion to the lower portion of the display module 41.

A lower portion of the guide member 44 may be provided with a descending path exit 47 formed thereto as to have the air moving downward through the descending path 46 guided toward the cooling fan 70. That is, the descending path exit 47 may be formed in between the guide member 44 and an electrical compartment bottom.

Through the structure as such, the display module 41 may be thoroughly cooled from the upper portion to the lower portion thereof, and thus, the cooling efficiency of the display module 41 may be increased.

In addition, as the cooling efficiency of the display module 41 is increased as the above, the display module 41 may use heat generating material provided to generate higher heat than conventional heat generating material as a light source, and at the time of cleaning the cooking compartment 30, a high-temperature cleaning, such as a pyrolytic cleaning, may be conducted. In addition, the thickness of insulation material 144 to insulate the electrical compartment 40 and the cooking compartment 30 may be provided to be thinner than the thickness of conventional insulation material, and accordingly, the size of the cooking compartment 30 may be expanded.

Meanwhile, as illustrated on FIG. 7, the guide member 44 may be a printed circuit board 45 that controls the display module 41. That is, the guide member 44, instead of using an additional component that is separately provided, but may use the printed circuit board 45 to control the display module 41. Through the above, the number of components may be decreased, and the material costs may be reduced.

The fixing member 48 fixes the display module 41 to the electrical compartment 40 may be provided with an opening unit 48*a* through which a cable 45*a* connecting the printed circuit board 45 and the display module 41 is passed.

Meanwhile, the guide member 44 or the printed circuit board 45 as such is not a needed component of the present disclosure, and may be omitted as illustrated on FIG. 8.

Figure 9:
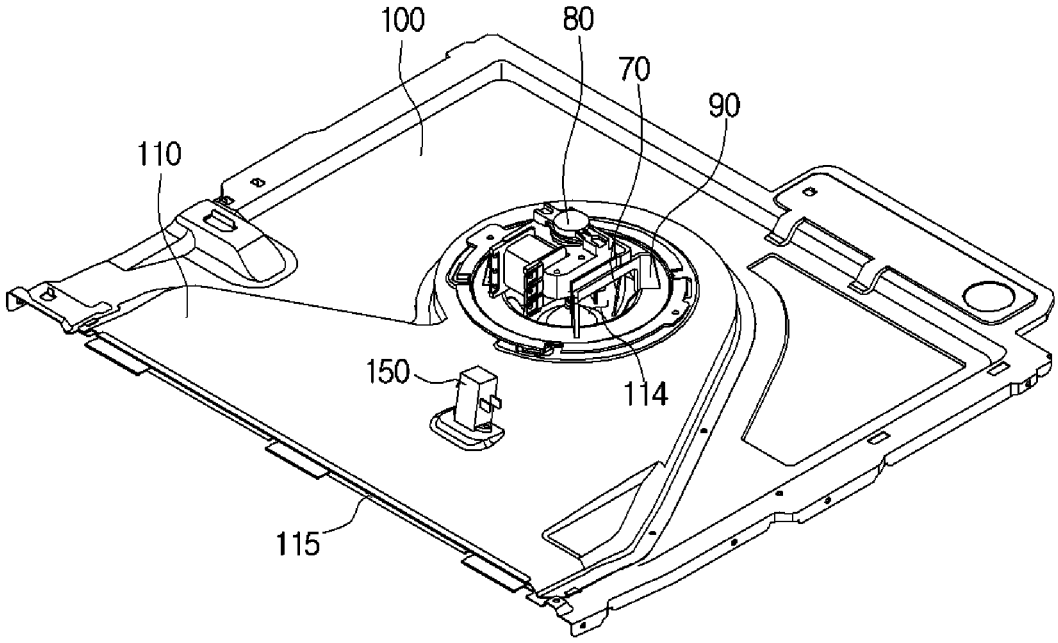
FIG. 9 is a coupled perspective view illustrating an exhaust structure of the oven of FIG. 1.
Figure 10:
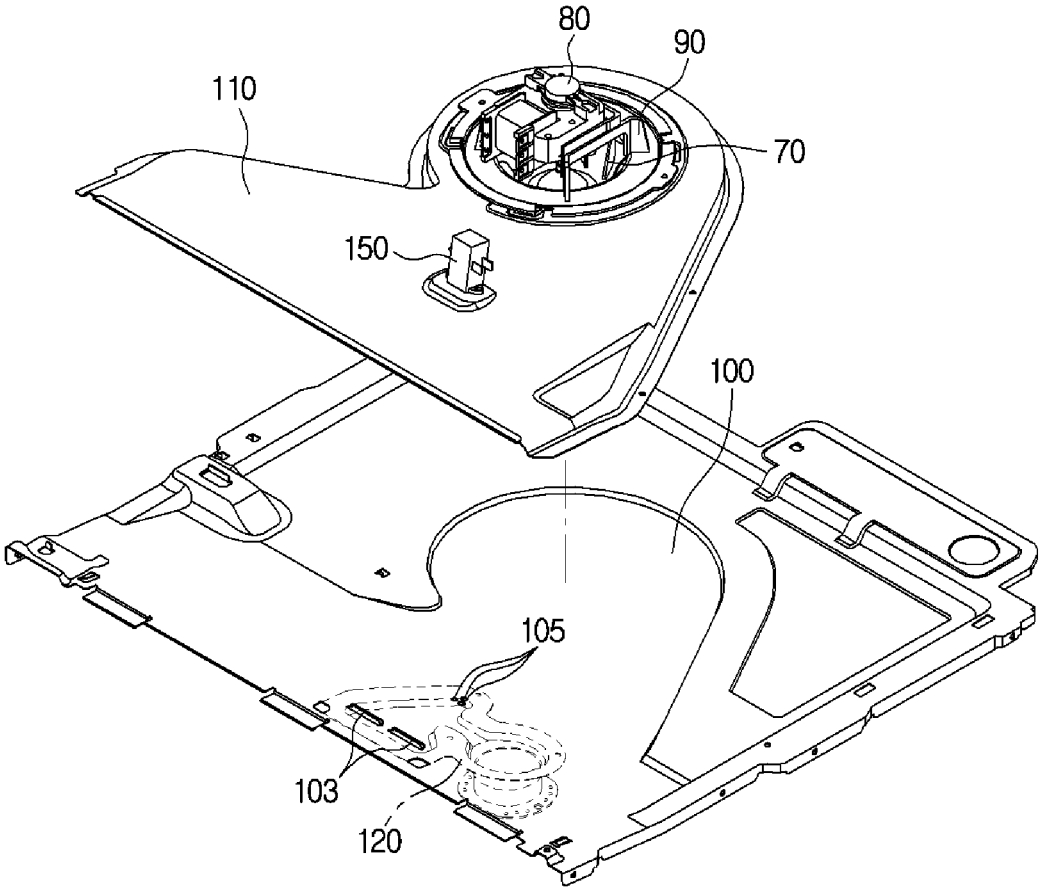
FIG. 10 is a perspective view illustrating the partially disassembled exhaust structure of the oven of FIG. 1.
Figure 11:
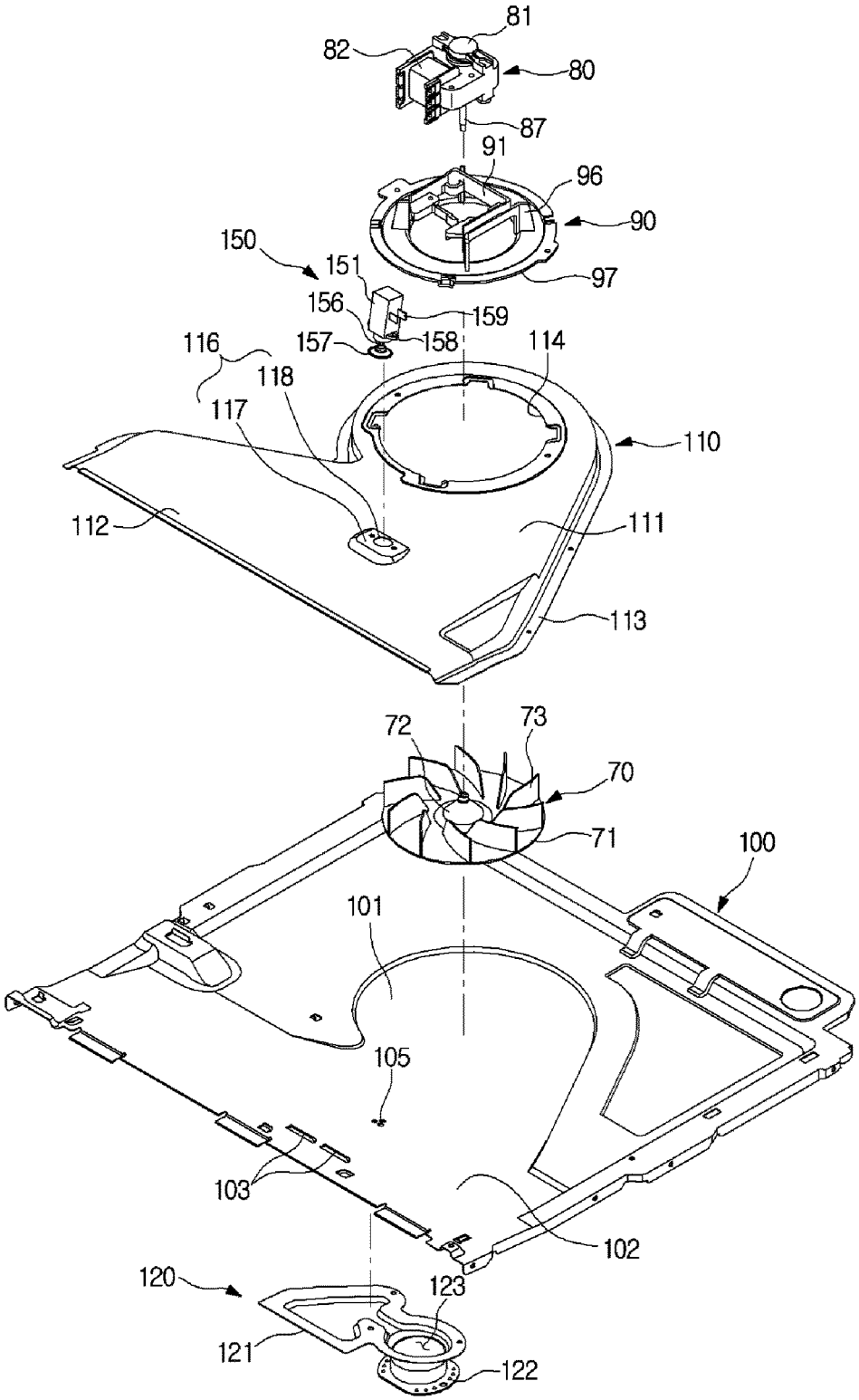
FIG. 11 is a perspective view illustrating the further disassembled exhaust structure of the oven of FIG. 1.
Figure 12:
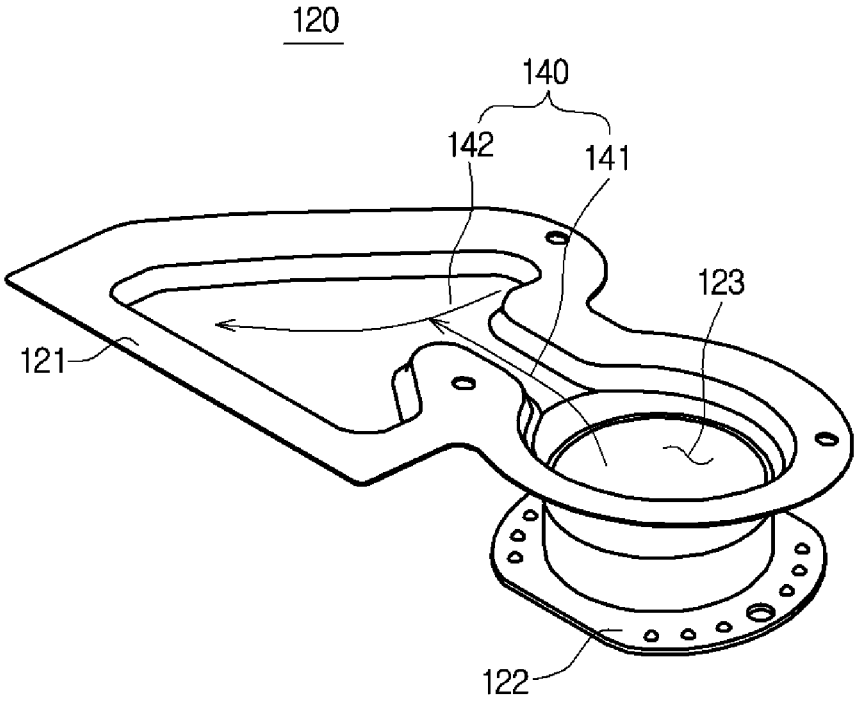
FIG. 12 is a perspective view illustrating an exhaust bracket of the oven of FIG. 1.
Figure 13:
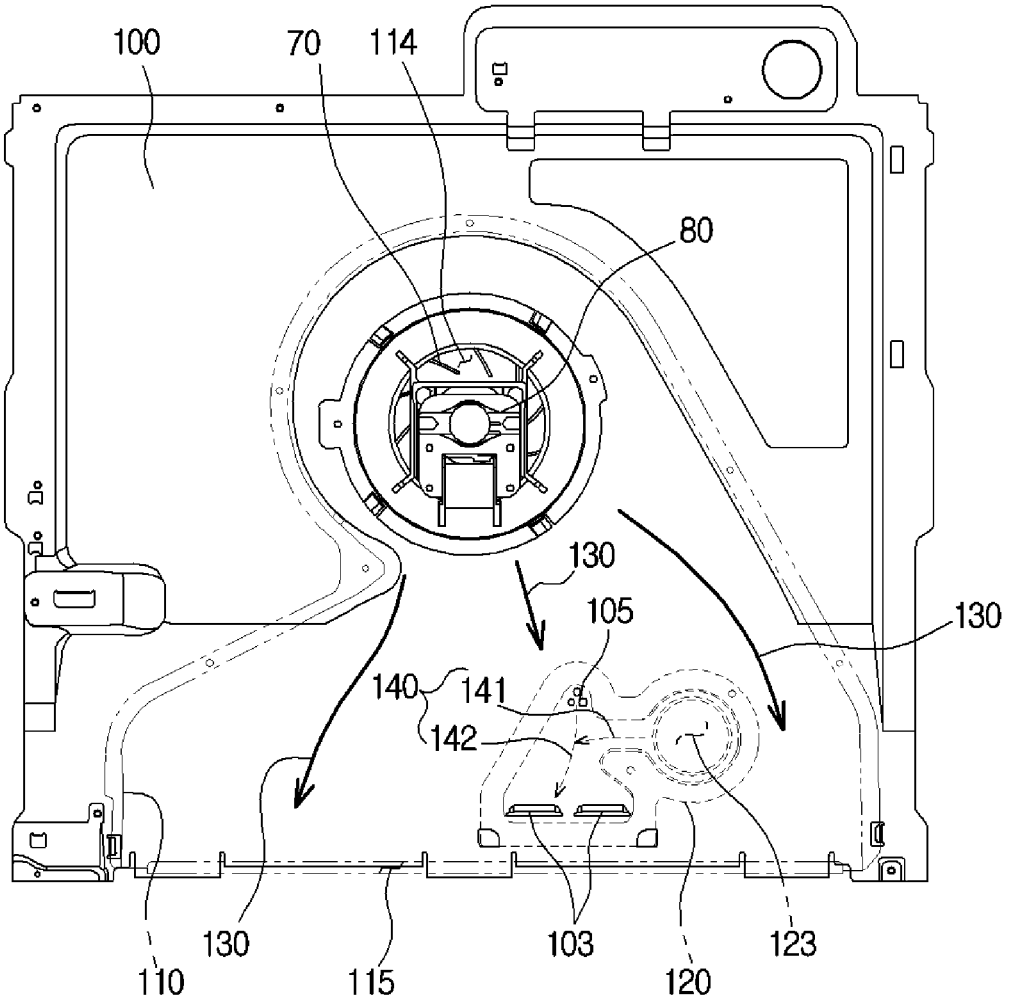
FIG. 13 is a plane view illustrating the exhaust bracket of the oven of FIG. 1.
Figure 14:
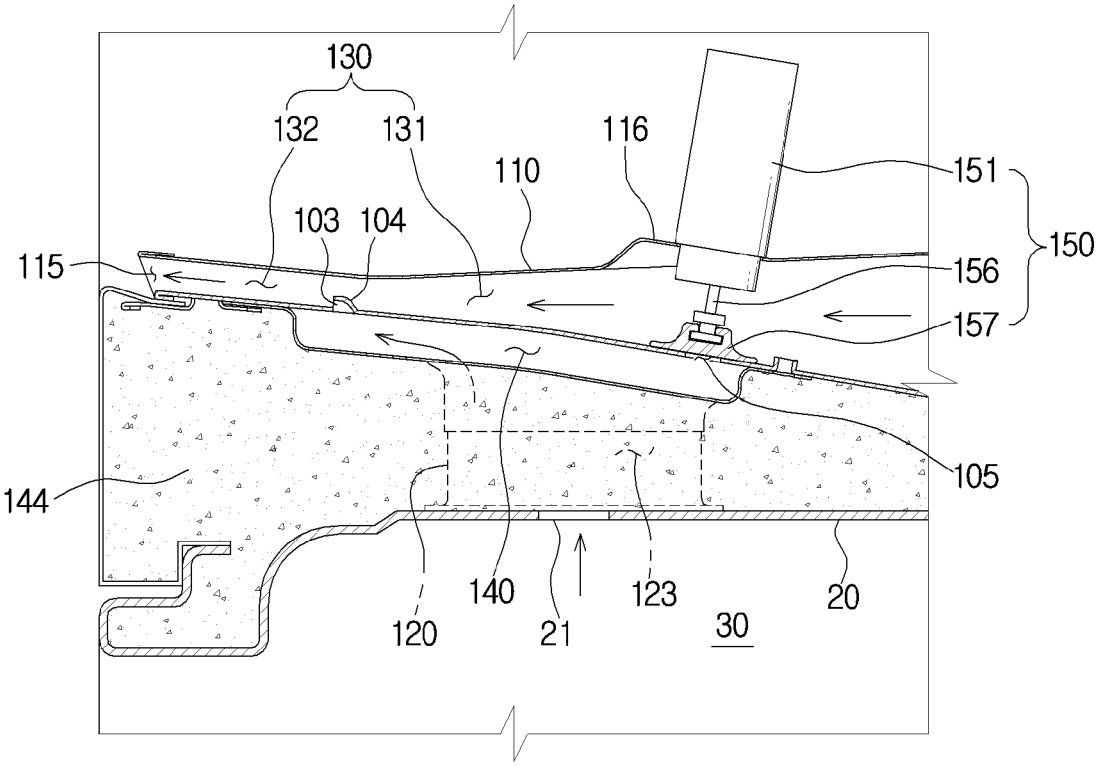
FIG. 14, as a drawing to describe motions of an opening/closing apparatus of the oven of FIG. 1, is a drawing illustrating a state that a bypass hole is closed by use of the opening/closing apparatus.
Figure 15:
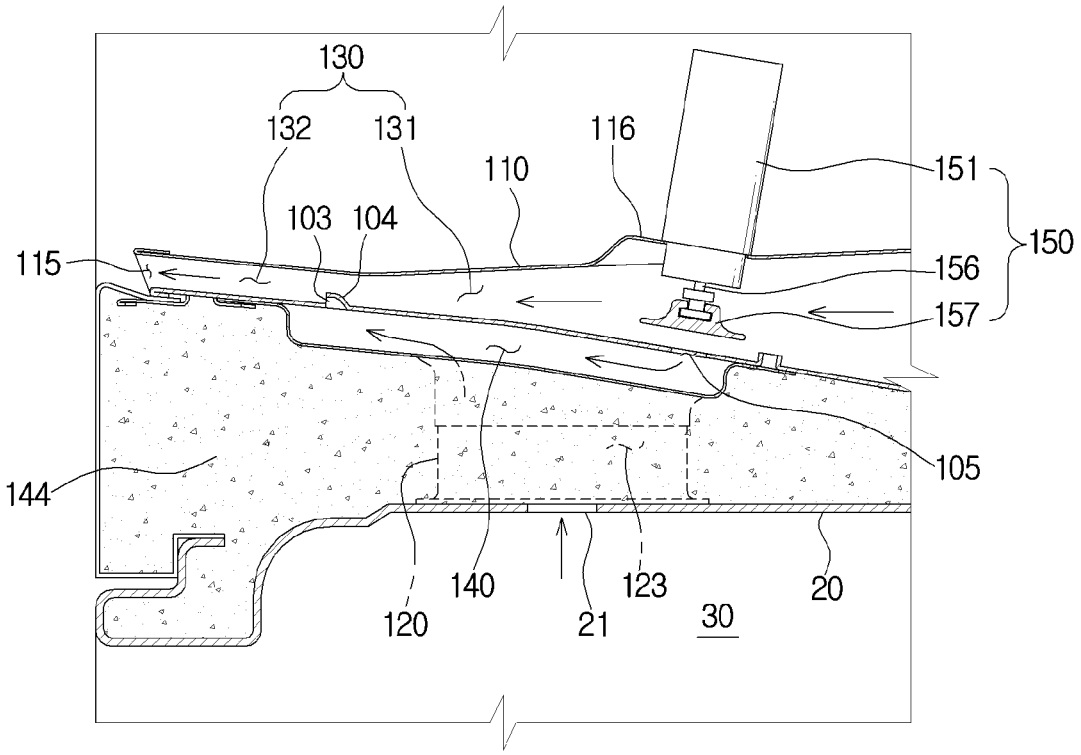
FIG. 15, as a drawing to describe motions of the opening/closing apparatus of the oven of FIG. 1, is a drawing illustrating a state that the bypass hole is open by use of the opening/closing apparatus.
Figure 16:
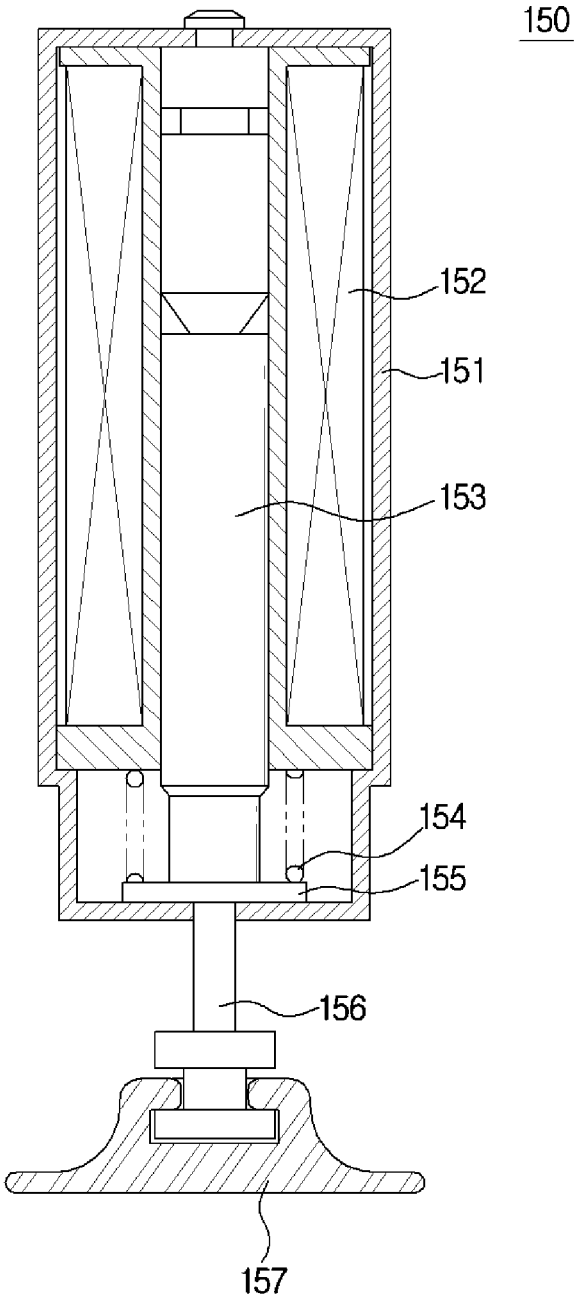
FIG. 16 is a cross-sectional view illustrating a structure of the opening/closing apparatus of the oven of FIG. 1.

FIG. 9 is a coupled perspective view illustrating an exhaust structure of the oven 1 of FIG. 1. FIG. 10 is a perspective view illustrating the partially disassembled exhaust structure of the oven 1 of FIG. 1. FIG. 11 is a perspective view illustrating the further disassembled exhaust structure of the oven 1 of FIG. 1. FIG. 12 is a perspective view illustrating an exhaust bracket of the oven 1 of FIG. 1. FIG. 13 is a plane view illustrating the exhaust bracket of the oven 1 of FIG. 1. FIG. 14, as a drawing to describe motions of an opening/closing apparatus of the oven 1 of FIG. 1, is a drawing illustrating a state that a bypass hole is closed by use of the opening/closing apparatus. FIG. 15, as a drawing to describe motions of the opening/closing apparatus of the oven 1 of FIG. 1, is a drawing illustrating a state that the bypass hole is open by use of the opening/closing apparatus. FIG. 16 is a cross-sectional view illustrating a structure of the opening/closing apparatus of the oven 1 of FIG. 1.

Referring to FIG. 9 through FIG. 16, the exhaust structure of the present disclosure will be described in detail.

The base bracket 100 may be provided with a scroll unit 101 formed such that the radius thereof is gradually increased following a clockwise direction when viewed from a top toward downward direction, and an outflow unit 102 formed at an end portion of the scroll unit 101. The outflow unit 115 is positioned at an end portion of the outflow unit 102.

The base bracket 100 is provided with the exhaust hole 103 to inflow the air of the exhaust path 140 into the cooling path 130 by use of the Venturi effect formed thereto. The exhaust hole 103 is formed at the width maintaining unit 132 of the cooling path 130 such that the Venturi effect may be generated.

That is, the pressure of the air that moves from the width decreasing unit 131 to the width maintaining unit 132 is reduced at the width maintaining unit 132 such that the air of the exhaust path 140 and the cooking compartment 30 may be suctioned in.

The exhaust hole 103 may be provided with reverse current preventing unit 104 (FIG. 14 and FIG. 15) as to prevent the air of the cooling path 130 from reversely flowing and moving into the exhaust path 140. The reverse current preventing unit 104 may be inclinedly formed at the base bracket 100 toward a front of an upper side.

The amount of the air being exhausted from the exhaust path 140 into the cooling path 130 through the exhaust hole 103 is practically even. In particular, the amount of the air is evenly maintained regardless of the opening/closing of the bypass hole 105, as the Venturi effect is mainly affected by the position and size of the exhaust hole 103.

The base bracket 100 is provided with the bypass hole 105 formed thereto as to inflow the air of the cooling path 130 into the exhaust path 140. The bypass hole 105 is formed at the width decreasing unit 131 of the cooling path 130.

The amount of the air exhausted from the exhaust path 140 to the cooling path 130 through the exhaust hole 103 is about same as the sum of the amount of the amount of the air exhausted from the cooking compartment 30 into the exhaust path 140 and the amount of the air that inflows from the cooling path 130 into the exhaust path 140 through the bypass hole 105.

Therefore, when comparing a case of having the bypass hole 105 to a case of not having the bypass hole 105, in the case of having the bypass hole 105, the amount of the air being exhausted from the cooking compartment 30 into the cooling path 130 is decreased.

Meanwhile, the exhaust hole 103 and the bypass hole 105 are both connected to the cooling path 130 and the exhaust path 140, and thus the exhaust hole 103 and the bypass hole 105 may be referred to as a first connecting hole and a second connecting hole, respectively.

The cover bracket 110 along with the base bracket 100 is provided to form the cooling path 130 while the cover bracket 110 is coupled to an upper portion of the base bracket 100. An upper surface of the cover bracket 110 may be provided with the inflow unit 114 of the cooling path 130 formed thereto. The cover bracket 110 may be provided with a coupling unit 113 as to be coupled to the base bracket 100.

The cover bracket 110 may be provided with a scroll unit 111 formed such that, as to correspond to the shape of the base bracket 100, the radius thereof is gradually increased following a clockwise direction when viewed from a top toward downward direction, and an outflow unit 112 formed at an end portion of the scroll unit 111. The outflow unit 115 is positioned at an end portion of the outflow unit 112.

The cover bracket 110 may be provided with an opening/closing apparatus mounting unit 116 to open/close the bypass hole 105. The opening/closing apparatus mounting unit 116 may include a supporting unit 117 to support the opening/closing apparatus 150, and a passing hole 118 at which the opening/closing apparatus 150 is passed through the cover bracket 110.

The opening/closing apparatus 150 may adjust the amount of the air of the cooking compartment 30 that is being exhausted into the cooling path 130 by opening/closing the bypass hole 105. That is, when the opening/closing apparatus 150 closes the bypass hole 105, the amount of the air of the cooking compartment 30 being exhausted into the cooling path 130 may be increased, and on the contrary, when the opening/closing apparatus 150 opens the bypass hole 105, the amount of the air of the cooking compartment 30 being exhausted into the cooling path 130 may be decreased.

The opening/closing apparatus 150 is provided with a rod 156 to move in a linear motion, and an opening/closing member 157 provided at an end portion of the rod 156 as to open/close the bypass hole 105. In addition, the opening/closing apparatus 150 is provided with a driving unit to offer driving force to the rod 156. The driving unit may be implemented in various methods, and as one example, the driving unit may be implemented in a solenoid method.

That is, the driving unit may be provided with a cylinder-shaped housing 151 having a hollow hole, a coil 152 wound at an inside of the cylinder-shaped housing 151, a spindle 153 provided at an inside of the coil 152 to be moved forward/backward and connected to the rod 156, an elastic member 154 elastically supporting the spindle 153, and an elastic member supporting unit 155 to support the elastic member 154.

When power is authorized at the coil 152, the coil 152 generates magnetic force, and the spindle 153 may be linearly moved toward an outer side of the cylinder-shaped housing 151 by use of the magnetic force. The rod 156 connected to the spindle 153 is also moved as the spindle 153 is moved to the outer side of the cylinder-shaped housing 151, and the opening/closing member 157 may close the bypass hole 105.

The opening/closing member 157 may be formed with rubber material as to enhance sealing performance.

When power is disconnected at the coil 152, the spindle 153 may be restored toward in an inner side of the cylinder-shaped housing 151 by use of the restoring force of the elastic member 154. The rod 156 connected to the spindle 153 is also moved as the spindle 153 is restored to the inner side of the cylinder-shaped housing 151, and the opening/closing member 157 may open the bypass hole 105.

The driving unit, other than the solenoid method as such, may be structured by being provided with an expansion member to expand when receiving heat, and a heater to guide the expansion member.

In addition, the opening/closing apparatus 150 may be provided with a terminal 159 configured such that power is received at the driving unit, and a coupling leg 158 coupled to the opening/closing apparatus mounting unit 116 of the cover bracket 110.

An upper portion of the cover bracket 110 may be provided with a supporting bracket 90 coupled thereto. The supporting bracket 90 may support a cooling motor 80. The supporting bracket 90 may include a motor coupling unit 91 to which the cooling motor 80 is coupled, a base unit 97 coupled to the cover bracket 110, and a bridge unit 96 connecting the base unit 97 and the motor coupling unit 91.

The cooling motor 80 is provided to generate rotational force to drive the cooling fan 70. The cooling motor 80 may be structured by use of a stator 82, and a rotator 81 rotating by use of the electromagnetic reciprocal action with respect to the stator 82. The rotator 81 may be provided with one end of a rotational axis 87 connected thereto, and the other end of the rotational axis 87 may be connected to the cooling fan 70.

The cooling fan 70 may be a centrifugal fan that has air flown in from an upper side and flown out in a radial direction. The cooling fan 70 may be disposed at the cooling path 130. That is, the cooling fan 70 may be disposed below the cover bracket 110 and above the base bracket 100.

The cooling fan 70 may include a rotating panel 71 evenly formed, a hub 72 formed at a central portion of the rotating panel 71 and to which the rotational axis 87 of the cooling motor 80 is coupled, and a plurality of wings 73 formed from the central portion of the rotating panel 71 toward an edge unit. The hub 72 may be formed in the shape of a cone having a radius thereof increased toward a lower portion, and thus, the air flown in at an upper side may be spread in a radial direction.

The exhaust bracket 120 along with the base bracket 100 is provided to form the exhaust path 140 while the exhaust bracket 120 is coupled to a lower portion of the base bracket 100. A lower portion of the exhaust bracket 120 may be provided with a connecting hole 123 formed thereto as the air of the cooking compartment 30 inflows into the exhaust path 140. The connecting hole 123 may be connected to the vent hole 21 (FIG. 14) formed at an upper surface of the inside case 20.

The exhaust bracket 120 may be provided with an upper coupling unit 121 coupled to the base bracket 100, and a lower coupling unit 122 coupled to the inside case 20.

The exhaust path 140 may include a first exhaust path 141 to guide the air flown in from the cooking compartment 30 into the cooling path 130, and a second exhaust path 142 to guide the air flown in through the bypass hole 105 into the cooling path 130. The first exhaust path 141 and the second exhaust path 142 may be merged at one point.

Figure 17:
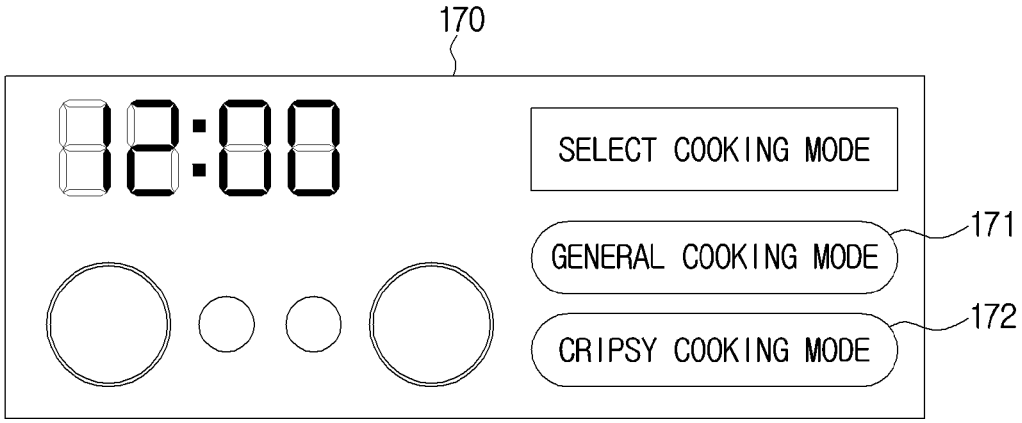
FIG. 17 is a drawing illustrating a cooking mode selection button of an input unit of the oven of FIG. 1.
Figure 18:
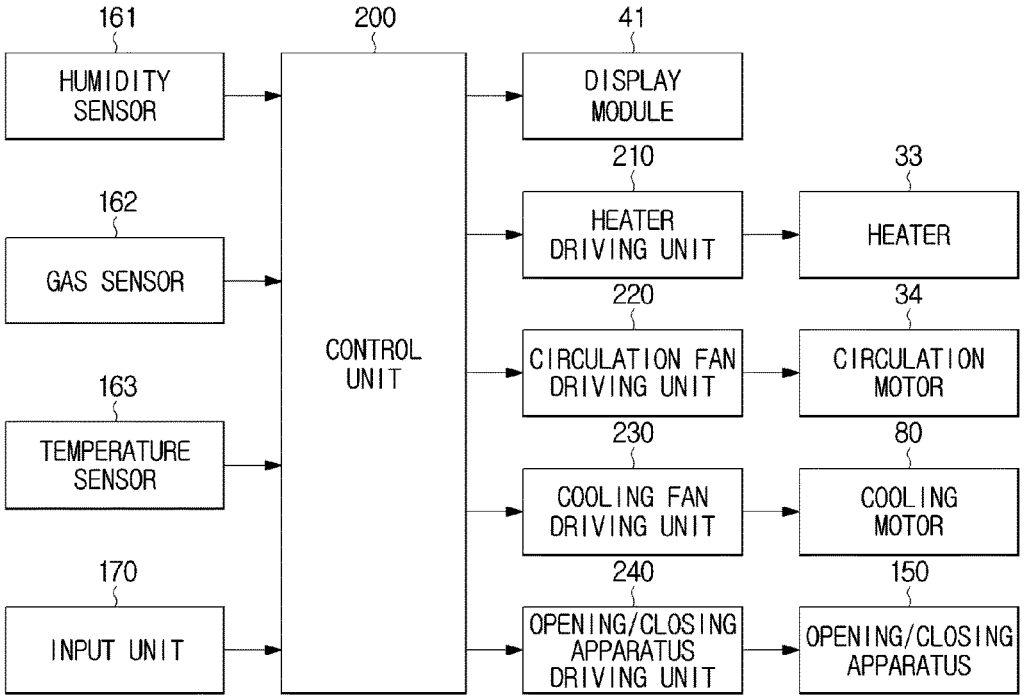
FIG. 18 is a controlled block diagram of the oven of FIG. 1.

FIG. 17 is a drawing illustrating a cooking mode selection button of an input unit of the oven of FIG. 1, and FIG. 18 is a controlled block diagram of the oven of FIG. 1.

Referring to FIG. 17 and FIG. 18, the motions of the oven according to the embodiments of the present disclosure will be briefly described.

The oven may be provided with a first cooking mode, and a second cooking mode to cook by having relatively higher amount of the air of the cooking compartment exhausted than the amount of the exhausted air of the first cooking mode.

According to the above, the first cooking mode may cook such that food may contain relatively further more moisture, and the second cooking mode may cook such that food may relatively be crispy by extracting moisture from the food.

As illustrated on FIG. 17, the oven 1 includes an input unit 170 to receive input of motion information. The input unit 170 may be implemented at the touch panel of the display module 41, which was described above, or may be separately provided with respect to the display module 41.

The input unit 170 includes various command buttons. In particular, the input unit 170 includes a general cooking mode selection button 171 and a crispy cooking mode selection button 172 provided as to select the cooking mode of the oven 1.

When the crispy cooking mode selection button 172 is selected, the oven is provided to perform the first cooking mode, which was described above, and when the crispy cooking mode selection button 172 is selected, the oven is provided to perform the second cooking mode.

The cooking mode information selected at the input unit 170 is delivered to a control unit 200. In addition, the control unit 200 is provided to receive status information of the cooking compartment 30 from sensors 161, 162, and 163 provided at the cooking compartment 30.

In some embodiments, the sensors 161, 162, and 163 may include a humidity sensor to sense the humidity of the cooking compartment 30, a gas sensor to sense the status of the gas of the cooking compartment 30, and a temperature sensor to sense the temperature of the cooking compartment 30.

The control unit 200 is provided to control the display module 41, a heater driving unit 210, a circulation fan driving unit 220, a cooling fan driving unit 230, and an opening/closing apparatus driving unit 240 on the basis of the cooking mode information selected at the input unit 170 and the status information of the cooking compartment 30 received from the sensors 161, 162, and 163.

The display module 41 may display the various status information of the cooking compartment 30, as well as the selected cooking mode information, at an outside.

The heater driving unit 210 may heat an inside of the cooking compartment 30 by driving the heater 33 disposed at an inside of the cooking compartment 30.

The circulation fan driving unit 220 may form convection current at an inside of the cooking compartment 30 by operating the circulation fan 35 through driving the circulation motor 34 disposed at the cooking compartment 30 such that the cooking compartment 30 may be evenly heated.

The cooling fan driving unit 230 may have air circulated at an outside of the cooking compartment 30 by operating the cooling fan 70 through driving the cooling motor 80 of the electrical compartment 40 such that the electrical compartment 40 may be cooled.

The opening/closing apparatus driving unit 240 may authorize/disconnect power at the driving unit of the opening/closing apparatus 150 so that the opening/closing apparatus 150 may open/close the bypass hole 105. Through the above, the opening/closing apparatus driving unit 240 may adjust the amount of the exhaust air of the cooking compartment 30.

In particular, the control unit 200 may control such that the air of the cooking compartment 30 may be relatively exhausted at the second cooking mode, that is, the crispy cooking mode, than at the first cooking mode, that is, the general cooking mode.

As one example, the bypass hole 105 is open for a certain period of time out of the entire cooking time during the first cooking mode, and the bypass hole 105 is closed for the entire period of time of the cooking time during the second cooking mode. The bypass hole 105 may be open for a certain period of time t1 during the first cooking mode, and the bypass hole 105 may be open for a certain period of time t2 during the second cooking mode, and the t1 may be greater than t2 (t1>t2).

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An oven, comprising:

a body having an inside case at which a cooking compartment is formed at an inside thereof and an outside case coupled to an outer side of the inside case;

an electrical compartment formed between the inside case and the outside case to accommodate electrical components;

a cooling fan provided at an inside of the electrical compartment, configured to generate an inflow force to inflow air at an outside of the body into the inside of the electrical compartment, and to outflow the air to a front of the body after having the air moved at the inside of the electrical compartment;

a display module provided at a front of the electrical compartment, and having an upper portion and a lower portion;

an outside air inlet unit formed at the body such that the outside air inlet unit is located above the display module;

a guide member provided at the electrical compartment as to interrupt the air inlet into the outside air inlet unit from moving toward the cooling fan and to guide the air to move from an upper portion of the display module to the lower portion of the display module;

a cooling path formed in between the electrical compartment and the cooking compartment as to guide the air flown in by use of the cooling fan to a front of the body;

an exhaust path connecting the cooking compartment and the cooling path as to exhaust the air of the cooking compartment into the cooling path;

a base bracket provided in between the cooking compartment and the electrical compartment;

an exhaust hole formed at the base bracket as to exhaust the air of the exhaust path into the cooling path; and a bypass hole formed at the base bracket as to have a portion of the air moving at a cooling path inlet into the exhaust path.

2. The oven of claim 1, wherein:

the outside air inlet unit is provided with a slit shape extended lengthways in both side directions of the body.

3. The oven of claim 1, wherein:

the body comprises an upper case forming an upper surface of the electrical compartment, and an electrical compartment cover forming a front surface of the electrical compartment while coupled to a front of the upper case, and the outside air inlet unit is formed in between the upper case and the electrical compartment cover.

4. The oven of claim 3, wherein:

the electrical compartment cover comprises a front surface unit, and a rear direction extension unit extended from the front surface unit to a rear;

the upper case comprises an upper surface unit, an upper direction extension unit extended from the upper surface unit to an upper direction, and a bend unit bent at the upper direction extension unit; and the outside air inlet unit is formed in between the rear direction extension unit and the bend unit.

5. The oven of claim 1, wherein:

the guide member is provided with a shape of a panel, and is disposed lengthways in a vertical direction at the electrical compartment.

6. The oven of claim 1, further comprising:

a descending path formed in between the guide member and the display module such that the air inlet through the outside air inlet unit is descended.

7. The oven of claim 6, wherein:

a lower side of the guide member is provided with a descending path exit formed thereof such that the air moving downward along the descending path moves toward the cooling fan.

8. The oven of claim 1, wherein:

the guide member comprises a printed circuit board to control the display module.

9. The oven of claim 1, wherein:

the display module comprises a liquid crystal display (LCD).

10. The oven of claim 9, wherein:

the display module comprises a touch panel to receive a command that is input through a touch while coupled to a front surface of the liquid crystal display.

11. The oven of claim 1, wherein:

the cooking compartment is provided at a lower side of the electrical compartment.

12. The oven of claim 11, further comprising:

a cover bracket coupled to an upper portion of the base bracket as to form the cooling path;

an exhaust bracket coupled to a lower portion of the base bracket as to form the exhaust path;

an opening/closing apparatus to open/close the bypass hole as to adjust an amount of the air of the cooking compartment being exhausted into the cooling path.

13. The oven of claim 12, wherein:

the amount of the air of the cooking compartment being exhausted into the cooling path is increased when the bypass hole is closed, and the amount of the air of the cooking compartment being exhausted into the cooling path is decreased when the bypass hole is open.

14. The oven of claim 12, wherein:

an amount of the air being exhausted from the exhaust path into the cooling path is about equal to a sum of the amount of the air being exhausted from the cooking compartment into the exhaust path and the amount of the air being inlet from the cooling path into the exhaust path through the bypass hole.

15. The oven of claim 12, wherein:

the amount of the air being exhausted from the exhaust path into the cooling path is steadily maintained regardless of the opening/closing of the bypass hole.

16. The oven of claim 12, wherein:

the cooling path comprises a width decreasing unit having an upper/lower gap narrowed further toward a front and a width maintaining unit having an upper/lower gap steadily maintained, and the bypass hole is formed at the width decreasing unit and the exhaust hole is formed at the width maintaining unit.

17. The oven of claim 12, wherein:

the opening/closing apparatus is mounted at the cover bracket.

18. The oven of claim 12, wherein:

the cover bracket is provided with an opening/closing apparatus mounting unit to mount the opening/closing apparatus, and the opening/closing apparatus mounting unit comprises a supporting unit at which the opening/closing apparatus is supported and a passing hole through which the opening/closing apparatus is passed.

19. The oven of claim 12, wherein:

the opening/closing apparatus comprises a rod to move in a linear motion, and an opening/closing member provided at an end portion of the rod as to open/close the bypass hole.

20. The oven of claim 11, further comprising:

a first cooking mode, and a second cooking mode to cook by exhausting a relatively higher amount of the air of the cooking compartment than an amount of the air of the cooking compartment in the first cooking mode.

* * * * *